US007357093B2

(12) United States Patent
Potter et al.

(10) Patent No.: US 7,357,093 B2
(45) Date of Patent: Apr. 15, 2008

(54) SUBMARINE EJECTION OPTIMIZATION CONTROL SYSTEM AND METHOD

(75) Inventors: Calvin C. Potter, Mesa, AZ (US); Dennis M. Alexander, Mesa, AZ (US); Paul T. Wingett, Mesa, AZ (US)

(73) Assignee: Honeywell International, Inc., Morristown, NJ (US)

( * ) Notice: Subject to any disclaimer, the term of this patent is extended or adjusted under 35 U.S.C. 154(b) by 205 days.

(21) Appl. No.: 11/170,862

(22) Filed: Jun. 30, 2005

(65) Prior Publication Data

US 2007/0022936 A1 Feb. 1, 2007

(51) Int. Cl.
*B63G 8/28* (2006.01)
*B63B 1/00* (2006.01)

(52) U.S. Cl. ..... 114/319; 114/238

(58) Field of Classification Search ..... 114/238
See application file for complete search history.

(56) References Cited

U.S. PATENT DOCUMENTS 3,807,274 A 4/1974 Cohen
4,643,072 A 2/1987 Hillebrecht
4,671,163 A 6/1987 Erikson
5,099,745 A 3/1992 Hubbell et al.
5,375,502 A 12/1994 Bitsakis
5,957,668 A 9/1999 Moody
6,112,667 A * 9/2000 Bailey et al. ..... 102/411
6,418,870 B1 7/2002 Lanowy et al.
6,502,528 B1 1/2003 MacLeod et al.
6,854,409 B1 2/2005 Galliano

* cited by examiner

*Primary Examiner*—Jesús D Sotelo
(74) *Attorney, Agent, or Firm*—Ingrassia Fisher & Lorenz

(57) ABSTRACT

A submersible vehicle object ejection control system stores a plurality of pump speed command profiles. Each pump speed command profile is based on vehicle depth, vehicle speed, type of object being ejected, maximum noise emission magnitude during object ejection, and object exit velocity. The system also receives data representative of current vehicle depth, current vehicle speed, and the type of object being ejected. In response to these data, the system retrieves one of the plurality of pump speed command profiles and supplies pump speed commands representative of the retrieved pump speed command profile.

17 Claims, 4 Drawing Sheets

SUBMARINE EJECTION OPTIMIZATION CONTROL SYSTEM AND METHOD

TECHNICAL FIELD

The present invention relates to a submersible vehicle object ejection system and, more particularly, to a object ejection system that provides an optimum ejection profile for a given object.

BACKGROUND

Many submersible vehicles, such as military submarines, include one or more object ejection systems. An object ejection system may be used to eject various types of objects from the vehicle. Such objects may include, for example, sonar buoys, counter measure devices, and various types of weapons, such as torpedoes and/or missiles. A typical object ejection system that is used to eject weapons from a submersible vehicle includes one or more weapon ejection tubes, an impulse tank, a boost pump, and an air turbine.

A weapon may be launched from an ejection tube by fluidly communicating the ejection tube with an impulse tank by, for example, opening a slide valve on the ejection tube, and then pressurizing the impulse tank with fluid. In many ejection systems the impulse tank is pressurized by commanding a firing valve to the open position, which allows high pressure air to flow to the air turbine. The air turbine, upon receiving the flow of high pressure air, drives the boost pump, which draws fluid (e.g., seawater) from the environment surrounding the vehicle hull and discharges the fluid, at a higher pressure, into the impulse tank.

Although the ejection system described above is generally safe, reliable, and robust, it does suffer certain drawbacks. For example, the ejection system is typically configured to provide a basic launch profile for a tube launch that is not easily or readily modifiable. The optimum launch profile for an object may vary depending, for example, on vehicle type, vehicle speed, vehicle depth, the type of object being launched, the desired object exit velocity, and the desired accoustic emission during the launch. By using only a single, basic launch profile, objects may not be ejected from the vehicle using the optimum launch profile for the given conditions during the launch.

Hence, there is a need for a submersible vehicle launch ejection system that launches objects from the vehicle using an optimized launch profile that is based on vehicle type, object type, and current vehicle conditions. The present invention addresses at least this need.

BRIEF SUMMARY

The present invention provides a submersible vehicle launch ejection system and method that launches objects from the vehicle using an optimized launch profile that is based on vehicle type, object type, and current vehicle conditions.

In one embodiment, and by way of example only, a submersible vehicle object ejection control system includes memory and a launch control circuit. The memory has stored therein a plurality of pump speed command profiles. Each pump speed command profile is based at least in part on vehicle depth, vehicle speed, type of object being ejected, maximum noise emission magnitude during object ejection, and object exit velocity. The launch control circuit is adapted to receive data representative of at least current vehicle depth, current vehicle speed, and the type of object being ejected and is operable, upon receipt thereof, to retrieve one of the plurality of pump speed command profiles from the memory and supply pump speed commands representative of the retrieved pump speed command profile.

Other independent features and advantages of the preferred object ejection system and method will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
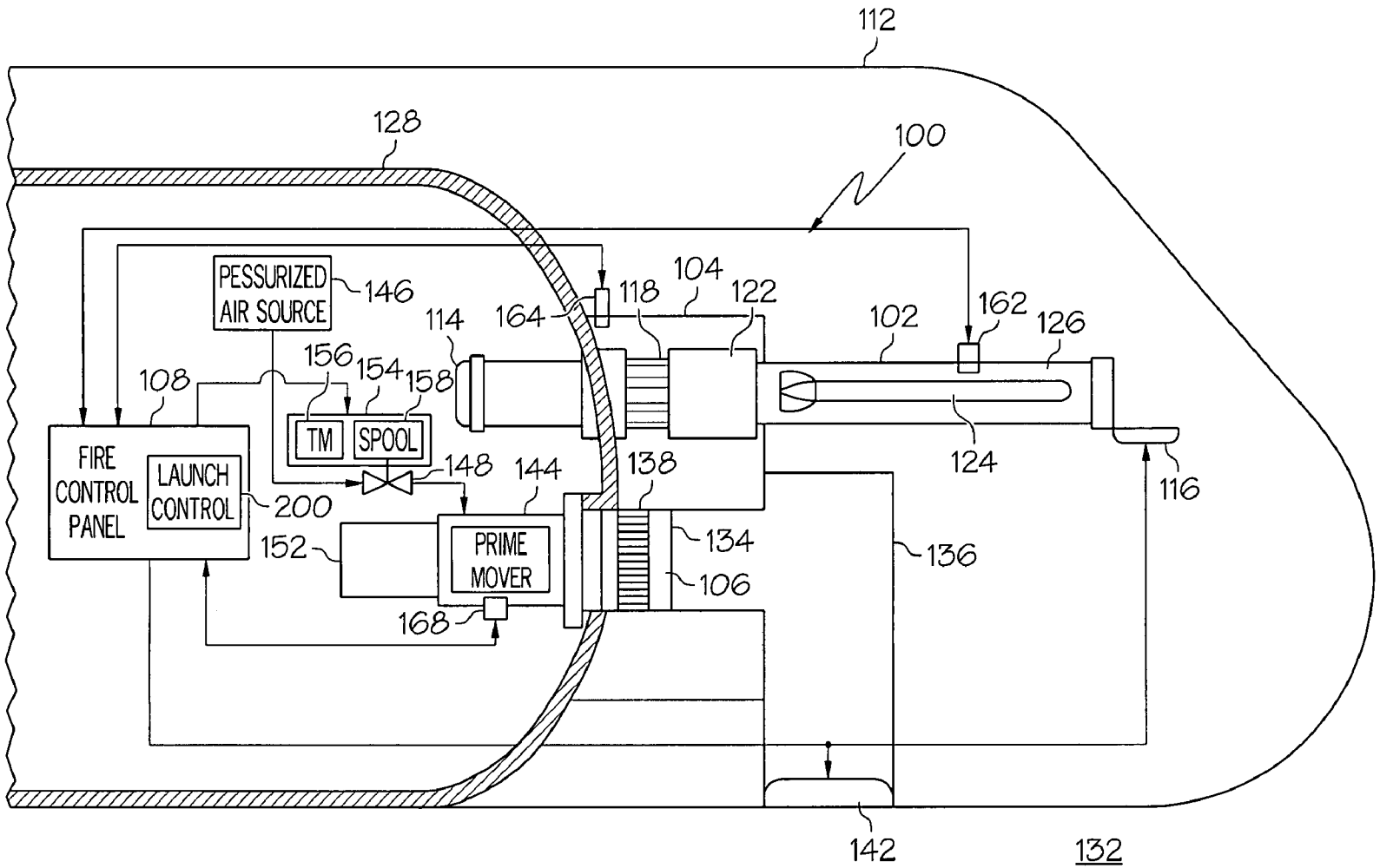
FIG. 1 is a functional block diagram of a submersible vehicle object ejection system according to an exemplary embodiment of the present invention.

Referring now to FIG. 1, a submersible vehicle object ejection system 100 is illustrated and includes one or more ejection tubes 102 (only one shown), an impulse tank 104, a pump 106, and a fire control panel 108, all disposed within, or at least partially within, the vehicle hull 112. The ejection tubes 102 each include a breach door 114, a muzzle door 116, a plurality of fluid inlets 118, and a slide valve 122. The breach doors 114 are opened to load an object, such as a weapon 124, into an inner volume 126 of the ejection tubes 102, and are then closed to seal the inner volume 126 from the inner hull 128. The muzzle doors 116 are normally closed to isolate the ejection tube inner volumes 126 from the environment 132 surrounding the vehicle hull 112, but are opened to allow ejection of the weapon 124 from the ejection tube 102 into the environment 132.

The fluid inlets 118 extend through the ejection tubes 102 and, depending on the position of the respective slide valves 122, fluidly communicate the impulse tank 104 to the inner volume 126 of the ejection tubes 102. In particular, the slide valves 122 are disposed between the fluid inlets 118 of the associated ejection tubes 102 and the impulse tank 104, and are moveable between an open position, in which the impulse tank 104 is fluidly communicated to the ejection tube inner volume 126, and a closed position, in which the impulse tank 104 is fluidly isolated from the ejection tube inner volume 126.

The impulse tank 104 is used to communicate pressurized fluid, such as water, to an ejection tube 102 that has its slide valve 122 open. The pressurized fluid in the impulse tank 104 is used to eject the weapons 124 from the ejection tubes 102. The pressurized fluid is supplied to the impulse tank 104 via the fluid pump 106. More specifically, at least in the depicted embodiment, the fluid pump 106 includes a fluid inlet 134 in fluid communication with a fluid supply conduit 136, and a fluid outlet 138 in fluid communication with the impulse tank 104. The fluid supply conduit 136 includes a fluid inlet valve 142 that, when open, allows fluid from the surrounding environment 132 to enter into the fluid supply conduit 136. The fluid pump 106, when driven, pumps fluid that enters the fluid supply conduit 136 into the impulse tank 104 at an increased pressure. The pressurized fluid supplied to the impulse tank 104 is used to eject the weapon 124 from a selected ejection tube 102. The system 100 additionally includes a tube pressure sensor 162 and an impulse tank pressure sensor 164 to sense the fluid pressure within the tube inner volume 126 and the fluid pressure in the impulse tank 104, respectively.

The fluid pump 106 is driven by a prime mover 144, which may be any one of numerous types of prime movers. For example, the prime mover 144 could be any one of numerous types of electric prime movers, any one of numerous types of hydraulic prime movers, or any one of numerous types of pneumatic prime movers. In the depicted embodiment, the prime mover 144 is a pneumatic-type of prime mover and, more specifically, is an air turbine 144 that is driven by pressurized air flow. The pressurized air flow is selectively supplied to the air turbine 144 from a pressurized air source 146 via, for example, a firing valve 148. The pressurized air source 146 may be any one of numerous sources of pressurized air, but in the depicted embodiment the pressurized air source 146 is the vehicle high pressure air system, which is typically maintained at a pressure of about 4,500 lbs/in$^2$.

The firing valve 148 is movable between an open position and a closed position. When the firing valve 148 is in an open position, pressurized air flows from the pressurized air source 146, into and through the air turbine 144. In response, the air turbine 144 rotates and drives the pump 106. As FIG. 1 additionally shows, a muffler 152 is preferably coupled to, and receives the flow of air that is exhausted from, the air turbine 144. The muffler 152 attenuates the noise as the air is exhausted from the air turbine 144.

The speed at which the air turbine 144 rotates the pump 106 is based on the flow rate of the pressurized air through the air turbine 144. The pressurized air flow rate through the air turbine 144 is controlled by positioning the firing valve 148 to a desired position. The position of the firing valve 148 is controlled via a valve actuator 154. In the depicted embodiment, the valve actuator 154 is a hydraulic actuator that is controlled via a torque motor 156 and a spool 158. The torque motor 156 receives torque motor position command signals and, in response, moves to the commanded torque motor position. The position of the torque motor 156 controls the flow of hydraulic fluid through the spool 158, which in turn controls the flow of hydraulic fluid supplied to the valve actuator 154. The valve actuator 154, based on the flow of hydraulic fluid supplied thereto, positions the firing valve 148 to the desired position. A speed sensor 168 senses the rotational speed of the pump 106, and supplies a pump speed feedback signal representative thereof. It will be appreciated that the depicted actuator is merely exemplary, and that the valve actuator 154 could alternatively be implemented as any one of numerous other types of actuators including, for example, electromechanical, hydraulic, and pneumatic, just to name a few.

Figure 2:
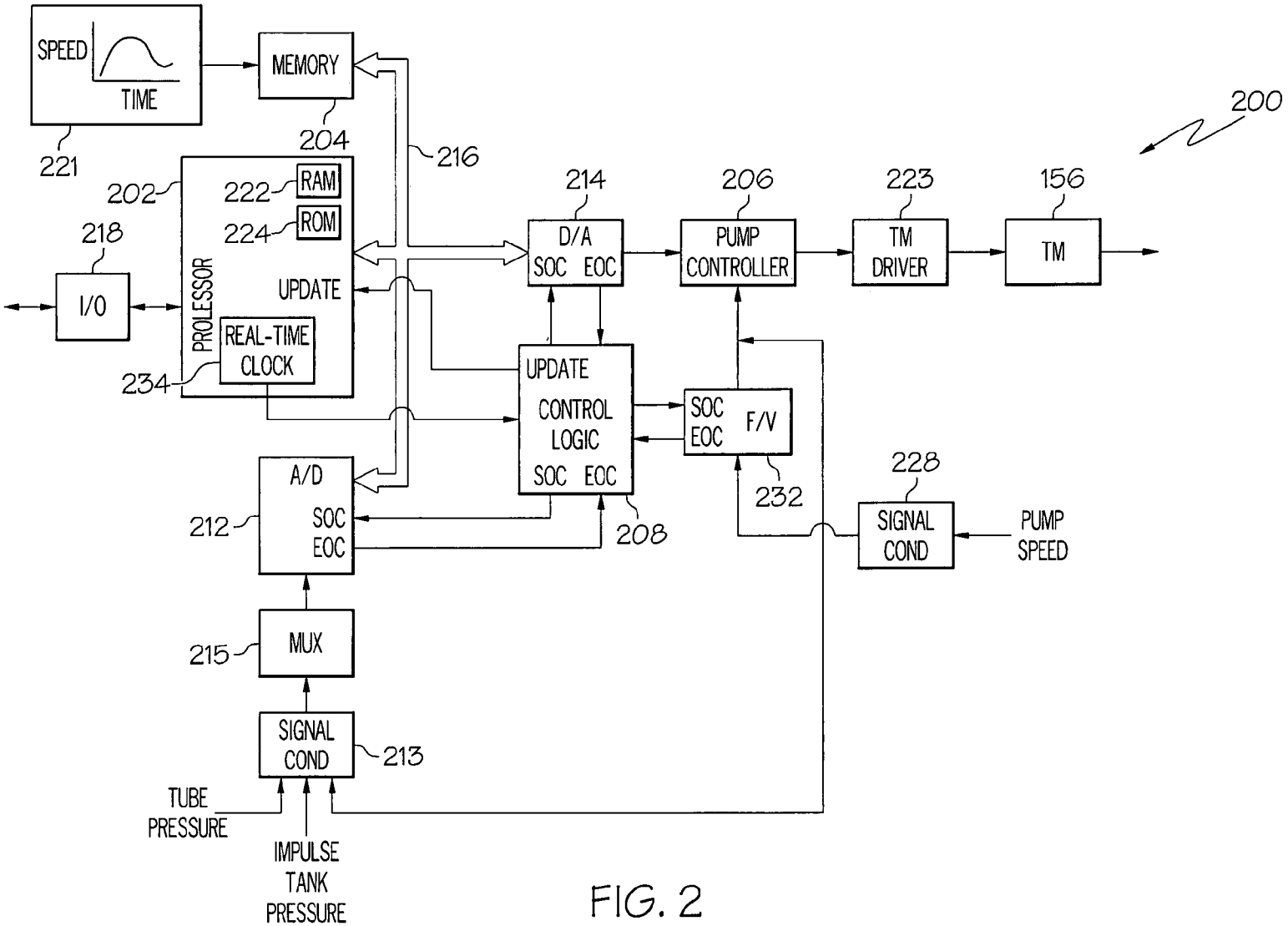
FIG. 2 is a block diagram of a launch control circuit that may be used in the object ejection system of FIG. 1.

The object ejection system 100 is preferably controlled from the fire control panel 108. The fire control panel 108 may be located within the same compartment as the other portions of the object ejection system 100 or in a different compartment or space within the vehicle hull 112. For example, in many military submarine applications the fire control panel 108 may be located within the control space (not shown). No matter its physical location, it will be appreciated that the fire control panel 108 includes various controls and man-machine interfaces that allow an operator to remotely control, for example, the position of the ejection tube muzzle doors 116, the slide valves 122, and fluid inlet valve 142. In the depicted embodiment, the fire control panel 108 also includes a launch control circuit 200 that is configured to monitor and/or control various devices and parameters, including the pump 106, the firing valve 148, fluid pressure within the tubes 102, fluid pressure in the impulse tank 104, pump speed, and acoustic emissions outside of the vehicle hull 112, in a manner that provides an optimized object ejection profile. A functional block diagram of an exemplary embodiment of the launch control circuit 200 is depicted in FIG. 2, and will now be described in more detail.

The launch control circuit 200 includes a processor 202, memory 204, a pump controller 206, and control logic 208. The processor 202 controls the overall operation of the launch control circuit 200, and is in operable communication with the memory 204, an analog-to-digital converter (A/D) circuit 212, and a digital-to-analog converter (D/A) circuit 214, via a communication bus 216. The processor 202 is additionally coupled to receive various commands and data via an I/O (input/output) communication port 218. These various commands and data, and the functionality implemented by the processor 202 upon receipt thereof, are described in more detail further below.

It will be appreciated that the processor 202 may include one or more microprocessors, each of which may be any one of numerous known general-purpose microprocessors or application specific processors that operate in response to program instructions. In the depicted embodiment, the processor 202 includes on-board RAM (random access memory) 222, and on-board ROM (read only memory) 224. The program instructions that control the processor 202 may be stored in either or both the RAM 222 and the ROM 224. For example, the operating system software may be stored in the ROM 224, whereas various operating mode software routines and various operational parameters may be stored in the RAM 222. It will be appreciated that this is merely exemplary of one scheme for storing operating system software and software routines, and that various other storage schemes may be implemented. It will also be appreciated that the processor 202 may be implemented using various other circuits, not just one or more programmable processors. For example, digital logic circuits and analog signal processing circuits could also be used.

The memory 204, which may be implemented as either, or both, RAM or ROM, has a plurality of pump speed command profiles stored therein. Each pump speed command profile is a digitized representation of the speed to which the pump 106 should be commanded, over the entire launch duration for an object, to provide the optimum launch profile. The pump speed command profiles are unique for each object, each vehicle, and the current vehicle conditions. For example, each pump command speed profile is based, at least in part, on vehicle depth, vehicle speed, the type of object being ejected, the maximum noise emission magnitude during object ejection, and desired object exit velocity. It will be appreciated that these data are merely exemplary of any one of numerous types of data that could be used to characterize the various pump speed command profiles that are stored in memory 204. Each pump speed command profile is obtained from real-time test data and from modeling of tube launches of various objects from various vehicles to attain a desired exit velocity and desired maximum acoustic emission during the launch. A graphical representation of an exemplary profile 221 that is stored in memory 204 is illustrated in FIG. 2.

The pump controller 206 is coupled to receive analog pump speed command signals from the D/A circuit 214 and the above-mentioned pump speed feedback signal from the pump speed sensor 168. The pump controller 206 may be configured as any one of numerous types of controllers. In the depicted embodiment, however, the pump controller 206 is implemented as a PID (proportional-integral-derivative) controller. The pump controller 206, using any one of numerous speed control laws, compares the pump speed command signals and the pump speed feedback signals and, based on the comparison, supplies a pump drive signal that will cause the fluid pump 106 to rotate at the commanded pump speed.

The pump drive signal is supplied either directly to the prime mover 144 or to an intermediate device, such as an actuator. For example, if the prime mover 144 is implemented as an electric device, such as an electric motor, the pump drive signal is supplied directly to the prime mover 144. Conversely, if the prime mover 144 is implemented as a hydraulic or pneumatic device, then the pump drive signal is supplied to an actuator driver circuit. The actuator drive circuit, in response to the pump speed drive signal, supplies actuator position command signals to an actuator, which in turn controls the flow of hydraulic or pneumatic fluid to the prime mover 144. For example, in the depicted embodiment, in which the prime mover 144 is an air turbine, the pump drive signal is supplied to a torque motor drive circuit 223. The torque motor drive circuit 223, in response to the pump drive signals, supplies the above-mentioned torque motor position signals to the torque motor 156.

The pump speed sensor 168, as was noted above, supplies the pump speed feedback signal to the pump controller 206. The pump speed sensor 168 may be implemented using any one of numerous types of rotational speed sensors now known or developed in the future including, for example, an optical sensor, a Hall effect sensor, a potentiometer, or a resolver. As FIG. 2 additionally shows, a signal conditioning circuit 228 and a frequency-to-voltage converter (F/V) circuit 232 are coupled between the pump speed sensor 168 and the pump controller 206. It will be appreciated that this is merely exemplary, and that the launch control circuit 200, depending on the type of pump speed sensor 168 that is used, could be implemented without either, or both, the signal conditioning circuit 228 and the F/V circuit 232.

The control logic 208 provides the appropriate time synchronization of the various control routines that are used to control various functions of the object ejection system 100. The control logic 208 may be implemented in software, hardware, firmware, or a combination thereof. In the depicted embodiment, however, the control logic 208 is implemented in software. No matter the how the control logic 208 is physically implemented, the control logic 208, under the control of a real-time clock 234 on the processor 202, supplies appropriate command signals to, and receives appropriate status signals from, the processor 202 and various other circuits that comprise the launch control circuit 200, to ensure the appropriate timing among the various functions. In this manner, the control logic 208 maintains synchronous operation of the launch control circuit 200. It will be appreciated that although the control logic 208 is depicted as a separate functional block, the processor 202 could be configured and/or programmed to implement the control logic functionality.

In the depicted embodiment, the command signals that the control logic 208 supplies include UPDATE commands and SOC (start-of-convert) commands, and the status signals the control logic 208 receives include EOC (end-of-convert) signals. The UPDATE commands are supplied to the processor 202, and the SOC commands are supplied to the D/A circuit 214, the A/D circuit 212, and the F/V circuit 232. The processor 202, upon receipt of an UPDATE command, supplies updated digital pump speed command data to the D/A circuit 214. The D/A circuit 214, the A/D circuit 212, and the F/V circuit 232, upon receipt of an SOC command signal, each implement appropriate signal conversion functionality upon completion of the signal conversion, supply an EOC signal to the control logic 208.

More specifically, the D/A circuit 214, upon receipt of an SOC command, converts digital pump speed command data to an analog signal for use by the pump controller 206 and upon completion of the conversion, supplies an EOC signal to the control logic 208. The A/D circuit 212, upon receipt of an SOC command, converts analog sensor signals to digital data signals for use by the processor 202 and, upon completion of the conversion, supplies and EOC signal to the control logic 208. As FIG. 2 shows, these analog sensor signals include pressure signals from the tube pressure sensor 162 and the impulse tank pressure sensor 164, and the pump speed feedback signal. As FIG. 2 additionally shows, these signals are preferably supplied to the A/D circuit 212 via a signal conditioning circuit 213 and a multiplexer 215. The F/V circuit 232, upon receipt of an SOC command, converts the conditioned pump speed feedback signal supplied from the pump speed sensor 168 and its associated signal conditioning circuit 228, which is a variable frequency AC signal, to a variable voltage DC signal. The DC signal is supplied to the pump controller 206 and, as was just noted, to the A/D circuit 212, via its associated signal conditioning circuit 213 and multiplexer 215. Upon completion of the conversion, the F/V circuit 232 supplies an EOC signal to the control logic.

Having described the configuration and general functionality of the object ejection system 100 and of the launch control circuit 200, a more detailed description of an exemplary process that the launch control circuit 200 implements so that an object is ejected from the object ejection system 100 using an optimized ejection profile will now be described. In doing so, reference should be made to FIGS. 3-5, which depicts the exemplary process in flowchart form. It is noted that the parenthetical references in the following paragraphs refer to like steps in the depicted flowchart.

Figure 3:
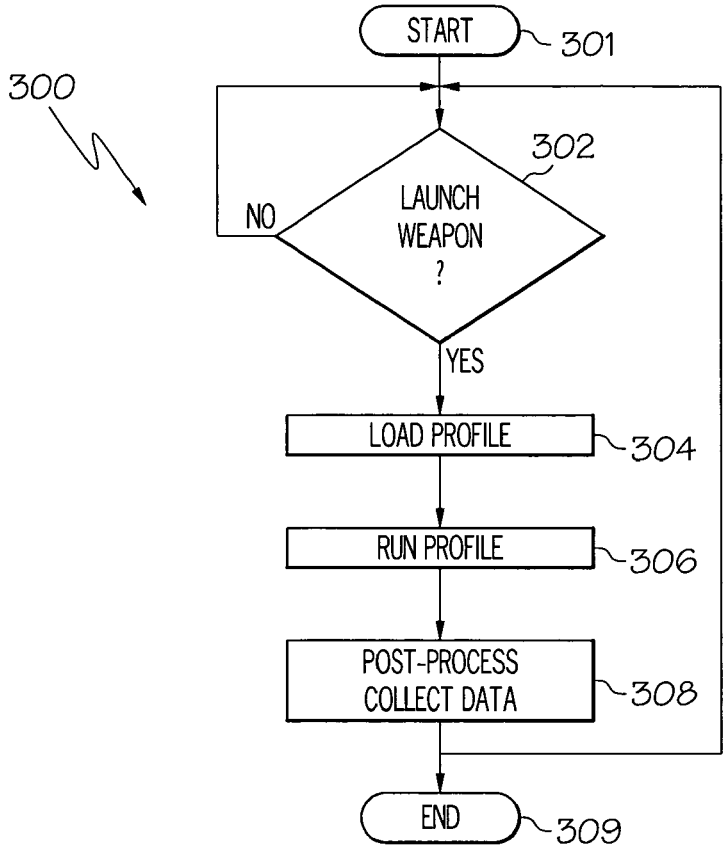
FIGS. 3-5 are flowcharts depicting exemplary processes that may be implemented by the launch control circuit of FIG. 2.

Referring first to FIG. 3, when a weapon 124 is not being launched, or readied for launch, the launch control circuit 200 is running a monitor process 300. During the monitor process 300, the processor 202 periodically queries the I/O communication port 218 to determine whether a weapon launch command has been received (302). If no weapon launch command has been received, the processor 202 continues to periodically query the I/O communication port 218. Conversely, if a weapon launch command has been received at the I/O communication port 218, the processor 202 retrieves the appropriate pump speed command profile from the memory 204 and loads it into, for example, onboard RAM 222 (304). The processor 202 then commands the remainder of the launch control circuit 200 to run the retrieved pump speed profile (306). As will be described further below, when the retrieved pump speed profile is being run, various data are collected. This collected data, upon completion of the pump speed profile implementation, is preferably post-processed (308).

Figure 4:
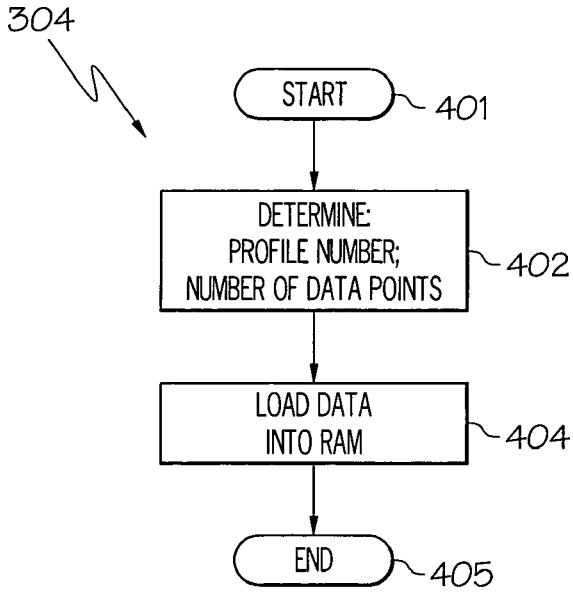

With reference now to FIG. 4, a more detailed flowchart of the process implemented by the launch control circuit 200 to retrieve the approrpriate pump speed command profile is shown. As was previously noted, the pump speed profile that the processor 202 retrieves from memory 204 is based on various parameters and data that are also supplied to the processor 202 via the I/O communication port 218. As was also previously noted, these parameters and data include the specific type of weapon 124 to be launched, the specific type of vehicle (e.g., ship class) in which the system 100 is installed, current vehicle depth, current vehicle speed, current and maximum noise emission during ejection, and desired exit velocity, just to name a few. In the depicted embodiment, each pump speed profile has an associated profile number and a predetermined number of associated data points. Thus, when the processor 202 receives a weapon launch command, it also receives these various parameters and data and, based on these parameters and data, determines the appropriate pump speed profile number and the number of data points associated with the appropriate pump speed profile number (402). The processor 202 then retrieves the data points from the memory 204 and stores the retrieved data points in the onboard RAM 222 (404). It will be appreciated that the various parameters and data that are used to determine the appropriate pump speed profile number may be supplied to the processor automatically, or one or more of the parameters and/or data may be manually input by an operator.

Figure 5:
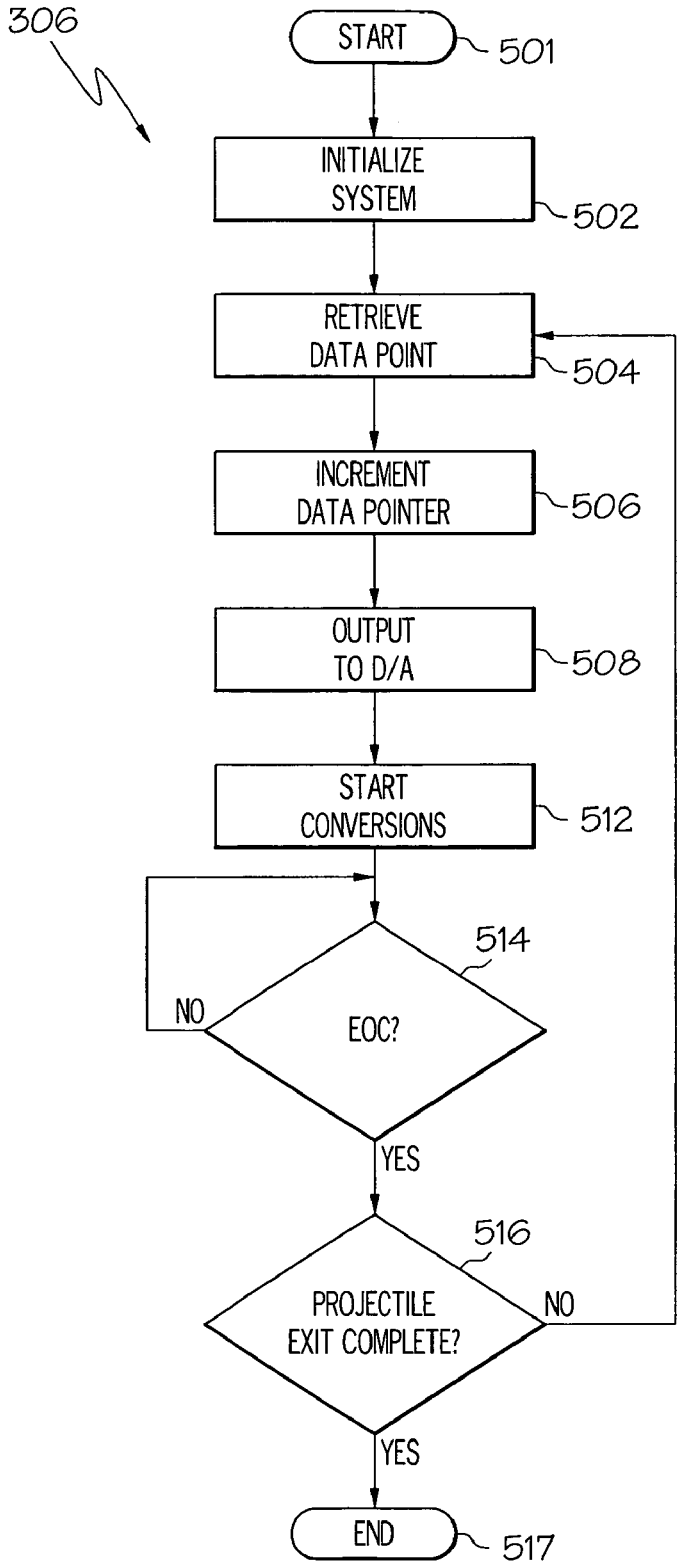

Returning briefly to FIG. 3, it is seen that when the appropriate pump speed profile is retrieved and loaded into the onboard RAM 222 (304), the processor 202 then commands the remainder of the launch control circuit 200 to run the retrieved pump speed profile (306). A more detailed flowchart of the process implemented by the launch control circuit 200 is shown in FIG. 5, and with reference thereto, will now be described in more detail.

Once the appropriate pump speed profile has been retrieved, the processor 202 and control logic 208 initialize the system 200 (502). The processor 202, based on signals from the control logic 208, which were described above, then begins receiving the pressure and pump speed signals supplied from the tube pressure sensor 162, the impulse tank pressure sensor 164, and the pump speed sensor 168, and retrieving the data points, one by one, from the onboard RAM 222. More specifically, control logic 208 commands the processor 202 to retrieve each data point (504), increment a data pointer (506), and supply the retrieved data point to the D/A circuit 214 (508). The D/A circuit 214, in response to SOC commands from the control logic 208, converts the data point to an analog pump speed command signal, and supplies the analog pump speed command signal to the pump controller 206 (512). The A/D circuit 212 and the F/V circuit 232, as was also described above, additionally respond to the SOC commands from the control logic 208 (512), to supply the digital external pressure signals, the digital impulse tank pressure signals, and digital pump speed feedback signals to the processor 202, and the analog pump speed feedback signals to the pump controller 206, respectively. Though not shown in the flowchart in FIG. 5, the pump controller 206, as described above, in response to the analog pump speed command signal and the pump speed feedback signal, supplies a pump drive signal that causes the fluid pump 106 to rotate at the commanded pump speed.

When the D/A circuit 214, the A/D circuit 212, and the F/V circuit 232 each complete its respective conversions, these circuits 214, 212, and 232 supply the above-described EOC signals to the control logic 208. The control logic 208, based on these EOC signals, determines when each of the conversions is complete (514). Upon completion of the conversions, the processor 202 determines whether the weapon has been fully ejected (516). If the weapon has been fully ejected, the pump speed profile run process (306) ends. However, if the weapon has not yet been fully ejected, the next pump speed profile data point is retrieved (504), the data pointer is incremented (506), the pump speed profile data point is supplied to the D/A circuit 214 (508), and the D/A, A/D, and F/V conversions are implemented (512, 514). These steps (504-514) are repeated until the weapon 124 has been fully ejected.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A submersible vehicle object ejection control system, comprising:

memory having stored therein a plurality of pump speed command profiles, each pump speed command profile based at least in part on vehicle depth, vehicle speed, type of object being ejected, maximum noise emission magnitude during object ejection, and object exit velocity;

a launch control circuit adapted to receive data representative of at least current vehicle depth, current vehicle speed, and the type of object being ejected and operable, upon receipt thereof, to (i) retrieve one of the plurality of pump speed command profiles from the memory and (ii) supply pump speed commands representative of the retrieved pump speed command profile;

a pump speed sensor adapted to sense a rotational speed of a pump and supply a pump speed sensor signal representative thereof; and a pump controller coupled to receive the pump speed commands and the pump speed sensor signal and operable, in response thereto, to (i) compare the pump speed commands and the pump speed sensor signal and (ii) supply a drive signal based on the comparison.

2. The system of claim 1, further comprising:

a fluid pump; and a prime mover coupled to receive the drive signal and operable, in response thereto, to rotate the fluid pump.

3. The system of claim 2, wherein the drive signal is representative of a commanded valve position, and wherein the prime mover further includes:

an air turbine adapted to rotate upon receipt of a flow of pressurized air;

a firing valve in fluid communication with the air turbine and adapted to couple to a source of pressurized air, the firing valve moveable between an open position, in which the pressurized air flows through the firing valve and into and through the air turbine, and a closed position, in which the pressurized air does not flow through the firing valve; and a valve actuator coupled to the firing valve, the valve actuator further coupled to receive the drive signal and operable, in response thereto, to move the valve to the commanded valve position.

4. The system of claim 3, wherein the valve actuator comprises:

a torque motor driver coupled to receive the drive signal and operable, in response thereto, to supply torque motor position commands representative of a commanded torque motor position;

a torque motor coupled to receive the torque motor position command signals and operable, upon receipt thereof to move to the commanded torque motor position.

5. The system of claim 2, wherein:

the prime mover comprises a motor; and the drive signal is supplied directly to the prime mover.

6. The system of claim 2, further comprising:

a fluid supply conduit having at least an inlet port coupled to a fluid source of a first pressure; and an impulse tank configured to receive fluid at a second pressure, the second pressure greater than the first pressure, wherein the fluid pump is disposed between the fluid supply conduit and the impulse tank and pumps fluid from the fluid source to the impulse tank at the second pressure.

7. The system of claim 6, further comprising:

a launch tube having a fluid inlet, a fluid outlet, and a flow passage therebetween, the fluid inlet in fluid communication with the impulse tank;

a slider valve mounted on the launch tube and movable between an open position, in which the the impulse tank is in fluid communication with the launch tube flow passage, and a closed position, in which the the impulse tank is not in fluid communication with the launch tube flow passage.

8. The system of claim 7, further comprising:

a tube pressure sensor configured to sense fluid pressure within the launch tube flow passage and supply a tube pressure signal representative thereof and a pump discharge pressure sensor configured to sense fluid pressure downstream of the fluid pump and supply a pump discharge pressure signal representative thereof.

9. The system of claim 8, wherein the launch control circuit is coupled to receive the tube pressure signal and the pump discharge pressure signal.

10. A submersible vehicle object ejection control system, comprising:

memory having stored therein a plurality of pump speed command profiles, each pump speed command profile based at least in part on vehicle depth, vehicle speed, type of object being ejected, maximum noise emission magnitude during object ejection, and object exit velocity;

a launch control circuit adapted to receive data representative of at least current vehicle depth, current vehicle speed, and the type of object being ejected and operable, upon receipt thereof, to (i) retrieve one of the plurality of pump speed command profiles from the memory and (ii) supply pump speed commands representative of the retrieved pump speed command profile;

a fluid pump;

a prime mover coupled to receive a drive signal and operable, in response thereto, to rotate the fluid pump; and a pump controller coupled to receive the pump speed commands and a pump speed sensor signal representative of a rotational speed of the fluid pump and operable, in response thereto, to (i) compare the pump speed commands and the pump speed sensor signal and (ii) supply the drive signal based on the comparison.

11. The system of claim 10, wherein the drive signal is representative of a commanded valve position, and wherein the prime mover further includes:

an air turbine adapted to rotate upon receipt of a flow of pressurized air;

a firing valve in fluid communication with the air turbine and adapted to couple to a source of pressurized air, the firing valve moveable between an open position, in which the pressurized air flows through the firing valve and into and through the air turbine, and a closed position, in which the pressurized air does not flow through the firing valve; and a valve actuator coupled to the firing valve, the valve actuator further coupled to receive the drive signal and operable, in response thereto, to move the valve to the commanded valve position.

12. The system of claim 11, wherein the valve actuator comprises:

a torque motor driver coupled to receive the drive signal and operable, in response thereto, to supply torque motor position commands representative of a commanded torque motor position;

a torque motor coupled to receive the torque motor position command signals and operable, upon receipt thereof, to move to the commanded torque motor position.

13. The system of claim 10, wherein:

the prime mover comprises a motor; and the drive signal is supplied directly to the prime mover.

14. The system of claim 10, further comprising:

a fluid supply conduit having at least an inlet port coupled to a fluid source of a first pressure; and an impulse tank configured to receive fluid at a second pressure, the second pressure greater than the first pressure, wherein the fluid pump is disposed between the fluid supply conduit and the impulse tank and pumps fluid from the fluid source to the impulse tank at the second pressure.

15. The system of claim 14, further comprising:

a launch tube having a fluid inlet, a fluid outlet, and a flow passage therebetween, the fluid inlet in fluid communication with the impulse tank;

a slider valve mounted on the launch tube and movable between an open position, in which the the impulse tank is in fluid communication with the launch tube flow passage, and a closed position, in which the the impulse tank is not in fluid communication with the launch tube flow passage.

16. The system of claim 15, further comprising:

a tube pressure sensor configured to sense fluid pressure within the launch tube flow passage and supply a tube pressure signal representative thereof and a pump discharge pressure sensor configured to sense fluid pressure downstream of the fluid pump and supply a pump discharge pressure signal representative thereof.

17. The system of claim 16, wherein the launch control circuit is coupled to receive the tube pressure signal and the pump discharge pressure signal.

* * * * *